US012352490B2

(12) United States Patent
Kang et al.

(10) Patent No.: US 12,352,490 B2
(45) Date of Patent: Jul. 8, 2025

(54) REFRIGERATOR

(71) Applicant: SAMSUNG ELECTRONICS CO., LTD., Suwon-si (KR)

(72) Inventors: Yonghyun Kang, Suwon-si (KR); Joongho Kim, Suwon-si (KR); Jungkeun Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 438 days.

(21) Appl. No.: 17/860,344

(22) Filed: Jul. 8, 2022

(65) Prior Publication Data

US 2023/0080310 A1 Mar. 16, 2023

Related U.S. Application Data

(63) Continuation of application No. PCT/KR2022/008978, filed on Jun. 23, 2022.

(30) Foreign Application Priority Data

Sep. 10, 2021 (KR) ..... 10-2021-0121300

(51) Int. Cl.
*F25D 23/06* (2006.01)

(52) U.S. Cl.
CPC ..... *F25D 23/063* (2013.01); *F25D 23/064* (2013.01); *F25D 23/067* (2013.01)

(58) Field of Classification Search
CPC ..... F25D 23/06; F25D 23/062; F25D 23/063; F25D 23/064; F25D 23/065;
(Continued)

(56) References Cited

U.S. PATENT DOCUMENTS

2009/0064701 A1* 3/2009 Bauer ..... F25D 23/063 62/298
2011/0072843 A1 3/2011 Cho et al.
(Continued)

FOREIGN PATENT DOCUMENTS

CN 211372914 U 8/2020
DE 10 2015 203 147 A1 8/2016
(Continued)

OTHER PUBLICATIONS

International Search Report dated Oct. 21, 2022 in International Patent Application No. PCT/KR2022/008978 (3 pages; 4 pages translation).
(Continued)

*Primary Examiner* — Andrew Roersma
(74) *Attorney, Agent, or Firm* — STAAS & HALSEY LLP

(57) ABSTRACT

A refrigerator including: an inner case defining a storage compartment and including a plurality of plates respectively formed by injection molding; an outer case coupled to an outer side of the inner case; and an insulation material interposed between the inner case and the outer case. A first plate among the plurality of plates includes a first front flange defining a part of a front surface of the inner case, and a second plate among the plurality of plates includes a second front flange defining another part of the front surface of the inner case and coupled to the first front flange.

18 Claims, 16 Drawing Sheets

(58) Field of Classification Search
CPC .. F25D 23/066; F25D 23/067; F25D 2323/06; F25D 2323/061
See application file for complete search history.

(56) References Cited

U.S. PATENT DOCUMENTS

| | | | | |
|---|---|---|---|---|
| 2014/0015394 | A1* | 1/2014 | Cha | F25D 11/02 312/404 |
| 2016/0282035 | A1* | 9/2016 | Sul | F25D 23/065 |
| 2018/0187957 | A1* | 7/2018 | Jung | F25D 23/062 |
| 2018/0187961 | A1* | 7/2018 | Lim | F25D 27/00 |
| 2020/0200466 | A1* | 6/2020 | Hwang | F25D 19/00 |
| 2020/0326116 | A1 | 10/2020 | Hong et al. | |
| 2023/0077776 | A1* | 3/2023 | Lee | F25D 23/064 312/406 |

FOREIGN PATENT DOCUMENTS

| | | | | | |
|---|---|---|---|---|---|
| DE | 102019213446 | A1 * | 3/2021 | | |
| EP | 3 339 781 | A1 | 6/2018 | | |
| JP | 5052235 | | 10/2012 | | |
| JP | 2015-200458 | | 11/2015 | | |
| KR | 1996-0005025 | | 2/1996 | | |
| KR | 10-2011-0035416 | | 4/2011 | | |
| KR | 20150012054 | A * | 2/2015 | | F25D 23/066 |
| KR | 10-2015-0021827 | | 3/2015 | | |
| KR | 10-2016-0115445 | | 10/2016 | | |
| KR | 10-2018-0074514 | | 7/2018 | | |
| KR | 10-2018-0080054 | | 7/2018 | | |
| KR | 10-2018-0080082 | | 7/2018 | | |
| KR | 10-2019-0014687 | | 2/2019 | | |
| KR | 20200095867 | A * | 8/2020 | | F25D 23/028 |
| KR | 10-2021-0032628 | | 3/2021 | | |
| WO | WO-2012045648 | A2 * | 4/2012 | | F25D 23/063 |

OTHER PUBLICATIONS

PCT/ISA/237 dated Oct. 21, 2022 in International Patent Application No. PCT/KR2022/008978 (5 pages).
Extended European Search Report dated Sep. 17, 2024 for European Application No. 22867514.6.

* cited by examiner

REFRIGERATOR

CROSS-REFERENCE TO RELATED APPLICATION(S)

This application is a continuation application, under 35 U.S.C. § 111(a), of International Application No. PCT/KR2022/008978, filed on Jun. 23, 2022, which claims priority to Korean Patent Application No. 10-2021-0121300, filed on Sep. 10, 2021, in the Korean Intellectual Property Office, the disclosure of which is incorporated by reference herein in its entirety.

BACKGROUND

1. Field

The present disclosure relates to a refrigerator, and more particularly, to a refrigerator including an inner case formed by assembling a plurality of injection-molded plates.

2. Description of Related Art

A refrigerator is a home appliance for storing food fresh and includes a main body including storage compartments and a cool air supply device configured to supply cool air to the storage compartments. The storage compartments include a refrigerator compartment maintained at about 0 to 5° C. to keep food in a chilled state and a freezer compartment maintained at about 0 to −30° C. to keep food in a frozen state. The storage compartments have open fronts to put/take food into/out of the storage compartments and the fronts of the storage compartments are opened and closed by doors.

A main body of a refrigerator may be formed by coupling an inner case with an outer case. The inner case defines the storage compartments and the outer case defines an external appearance of the refrigerator. An insulation material is interposed between the inner case and the outer case to insulate the storage compartments.

SUMMARY

Provided is a refrigerator including an inner case formed by assembling a plurality of injection-molded plates.

Provided is a refrigerator in which a front flange defining a front surface of an inner case is integrally formed with a plate defining the inner case.

Provided is a refrigerator in which a plurality of front flanges of a plurality of plates forming an inner case are coupled with each other.

In accordance with an aspect of the present disclosure, a refrigerator includes: an inner case forming a storage compartment and including a plurality of plates respectively formed by injection molding; an outer case coupled with the inner case; and an insulation material interposed between the inner case and the outer case, wherein a first plate among the plurality of plates includes a first front flange forming a part of a front surface of the inner case, and a second plate among the plurality of plates includes a second front flange defining another part of the front surface of the inner case and couplable to the first front flange.

The first front flange may include a hook coupler, the second front flange includes a hook holder, and the hook coupler is coupled to the hook holder by hooking the hook coupler to the hook holder.

The hook coupler may include a hook body formed to protrude from the first front flange and being elastically deformable, and a hook protrusion formed at one end of the hook body, wherein the hook holder includes a holder body and a holding protrusion formed to be caught by the hook protrusion.

The hook body is supported by a rear surface of the holder body while the hook coupler is coupled to the hook holder.

The hook holder may include a rear support disposed behind the hook body to support the hook body, and the rear support includes an opening to guide elastic deformation of the hook body.

The hook holder may include an upper support to support a top surface of the hook protrusion and a lower support to support a bottom surface of the hook protrusion.

The hook body may constitute a part of the mounting groove on which a hot pipe to prevent formation of dew on the outer case is mounted.

The hook coupler is formed with a slope inclined upward to the right and toward the hook holder, and the hook holder may include a slope support surface inclined to support the slope.

The second front flange may include a movement prevention protrusion insertable into the first front flange to support the first front flange along a forward and backward direction.

The first front flange may include a movement prevention groove into which the movement prevention protrusion is insertable.

The first front flange may comprises: a first exposed surface forming a part of a front surface of a main body of the refrigerator; a first outer case support surface formed to be stepped from the first exposed surface to support the outer case; and a first mounting groove on which a hot pipe to prevent formation of dew on the outer case is mountable, and the second front flange may include: a second exposed surface defining another part of the front surface of the main body of the refrigerator; a second outer case support surface formed to be stepped from the second exposed surface to support the outer case; and a second mounting groove on which the hot pipe is mountable.

The first exposed surface may include a first surface of the first exposed surface formed to extend along the horizontal direction of the refrigerator, and a second surface of the first exposed surface formed to extend from one end of the first surface of the first exposed surface along the vertical direction of the refrigerator.

The first outer case support surface may include a first surface of the first outer case support surface formed to extend along the horizontal direction, and a second surface of the first outer case support surface formed to extend from one end of the first surface of the first outer case support surface along the vertical direction.

A lower end of the second surface of the first exposed surface may be located at a height corresponding to that of a lower end of the second surface of the first outer case support surface.

The first front flange extends along a transverse direction of the refrigerator, the second front flange extends along a longitudinal direction of the refrigerator, and the first front flange may be coupled to the second front flange along the transverse direction.

The first plate may include a first edge, the second plate includes a second edge facing the first edge, and the first front flange is couplable to the second front flange by coupling the first edge to the second edge.

In accordance with another aspect of the present disclosure, a refrigerator includes: an inner case forming a storage compartment and including a plurality of plates respectively formed by injection molding; an outer case coupled with the inner case; and an insulation material interposed between the inner case and the outer case, wherein a first plate among the plurality of plates includes a first front flange forming a part of a front surface of the inner case, a second plate among the plurality of plates includes a second front flange forming another part of the front surface of the inner case, and the first front flange is formed to partially overlap with the second front flange along a forward and backward direction of the inner case in while the first plate is coupled to the second plate.

The first front flange may include a hook coupler, and the second front flange may include a hook holder couplable to the hook coupler.

The hook coupler may partially overlaps with the hook holder along a forward and backward direction while the first plate is coupled to the second plate.

The second front flange may include a movement prevention protrusion formed to be insertable into the first front flange to support the first front flange along the forward and backward direction.

The first front flange may include a region overlapping with the movement prevention protrusion along the forward and backward direction while the first plate is coupled to the second plate.

BRIEF DESCRIPTION OF THE DRAWINGS

The above and other aspects, features, and advantages of certain embodiments of the present disclosure will be more apparent from the following description taken in conjunction with the accompanying drawings of which.

DETAILED DESCRIPTION

Figure 1:
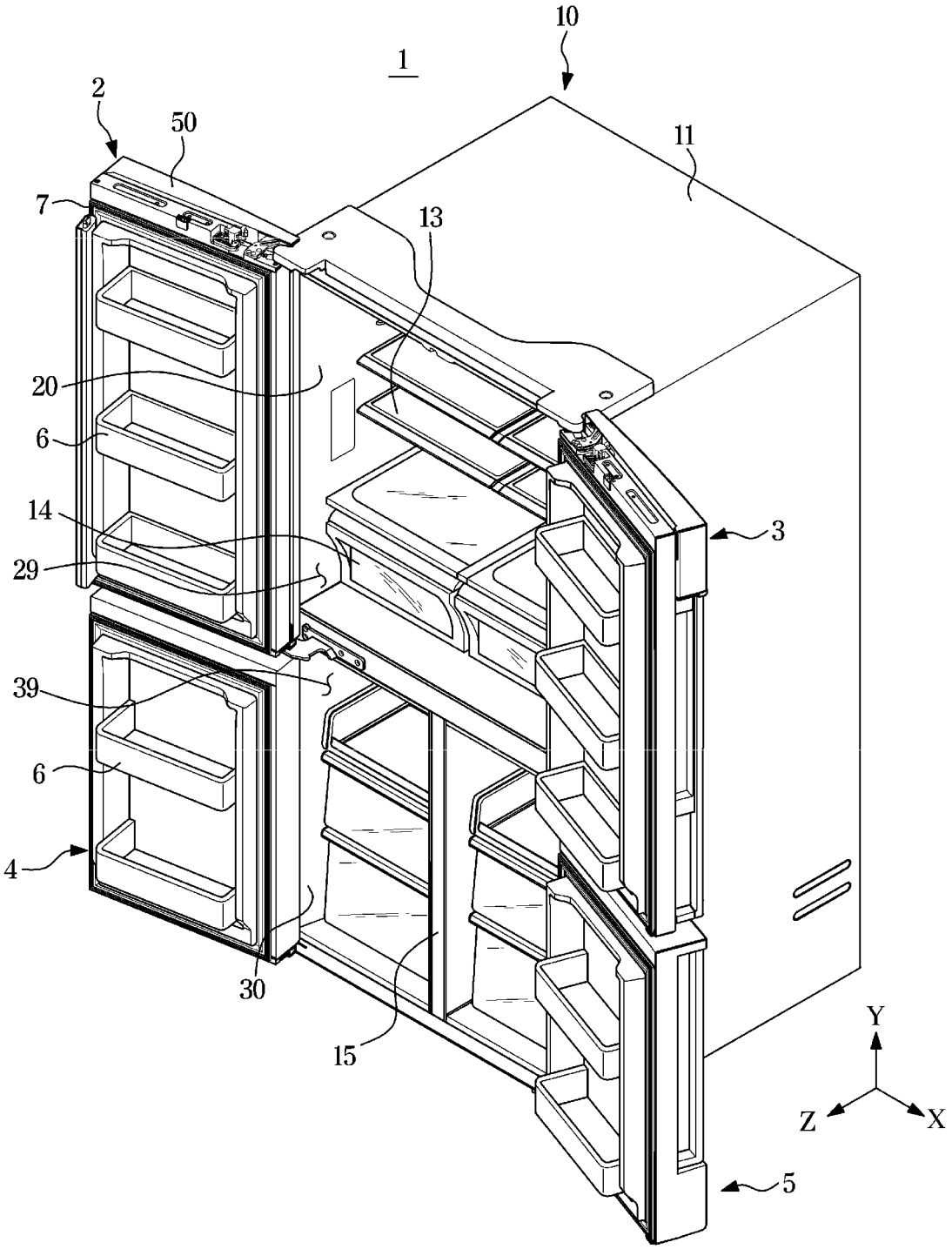
FIG. 1 is a view illustrating an external appearance of a refrigerator according to an embodiment of the present disclosure.

Reference will now be made in detail to the embodiments of the present disclosure, examples of which are illustrated in the accompanying drawings. The embodiments described in the specification and shown in the drawings are only illustrative and are not intended to represent all aspects of the invention, such that various equivalents and modifications may be made without departing from the spirit of the invention.

An expression used in the singular encompasses the expression of the plural, unless otherwise indicated. Throughout the specification, the terms such as "including" or "having" are intended to indicate the existence of features, numbers, operations, components, parts, or combinations thereof disclosed in the specification, and are not intended to preclude the possibility that one or more other features, numbers, operations, components, parts, or combinations thereof may exist or may be added.

Throughout the specification, although the terms "first", "second", and the like may be used herein to describe various elements, these elements should not be limited by these terms. These terms are only used to distinguish one element from another element.

According to the present disclosure, the inner case of the refrigerator may be formed by assembling a plurality of injection-molded plates.

According to the present disclosure, front flanges defining the front surface of the inner case may be integrally formed with the plurality of plates assembled to form the inner case.

According to the present disclosure, assembling convenience may be improved because the front flanges of the plurality of plates are coupled simultaneously with coupling of the plurality of plates.

According to the present disclosure, deformation of the front flanges of the plurality of plates and gap formation between the front flanges may be prevented.

Figure 2:
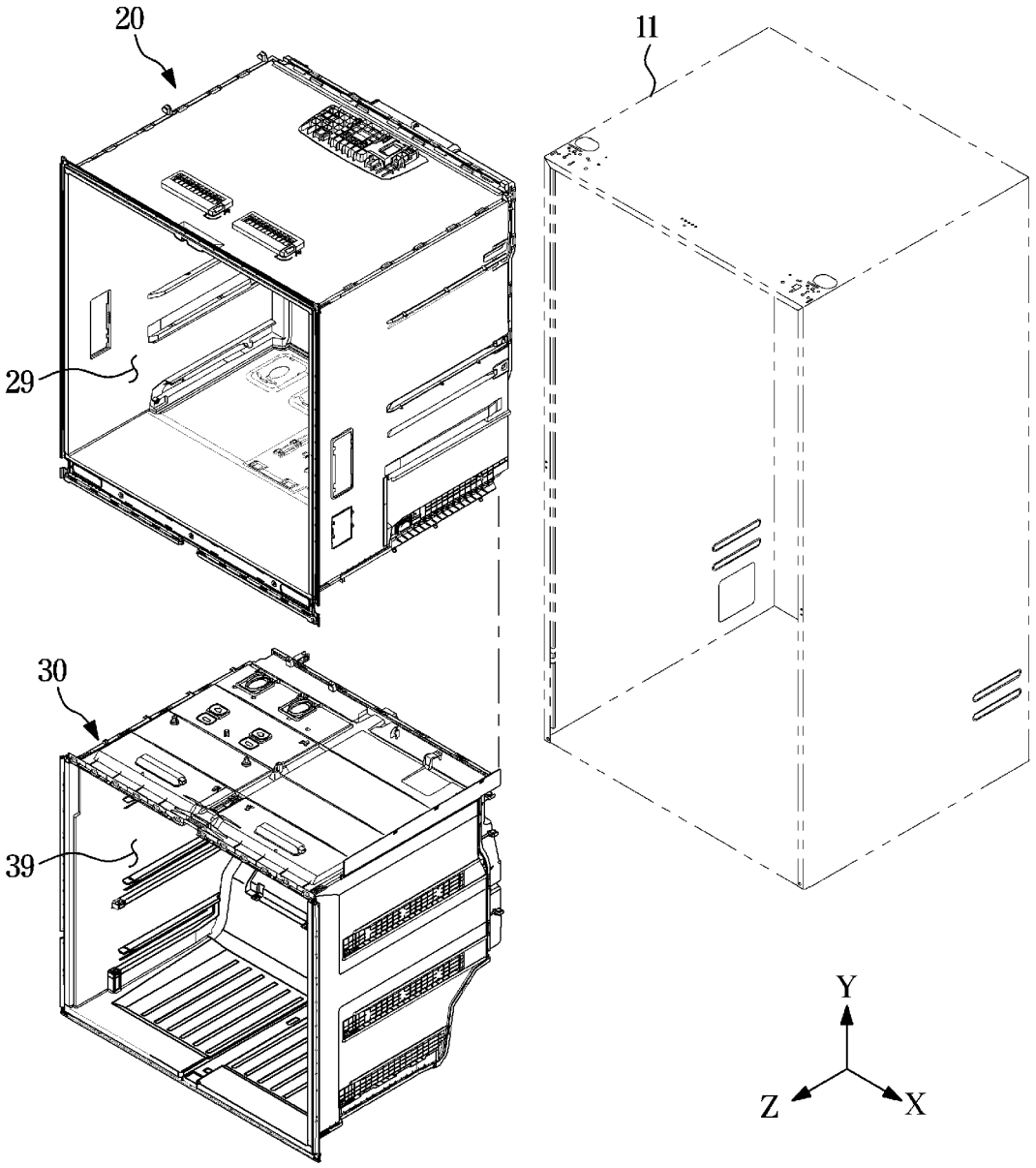
FIG. 2 is an exploded view illustrating a first inner case, a second inner case, and an outer case of a refrigerator according to an embodiment of the present disclosure.
Figure 7:
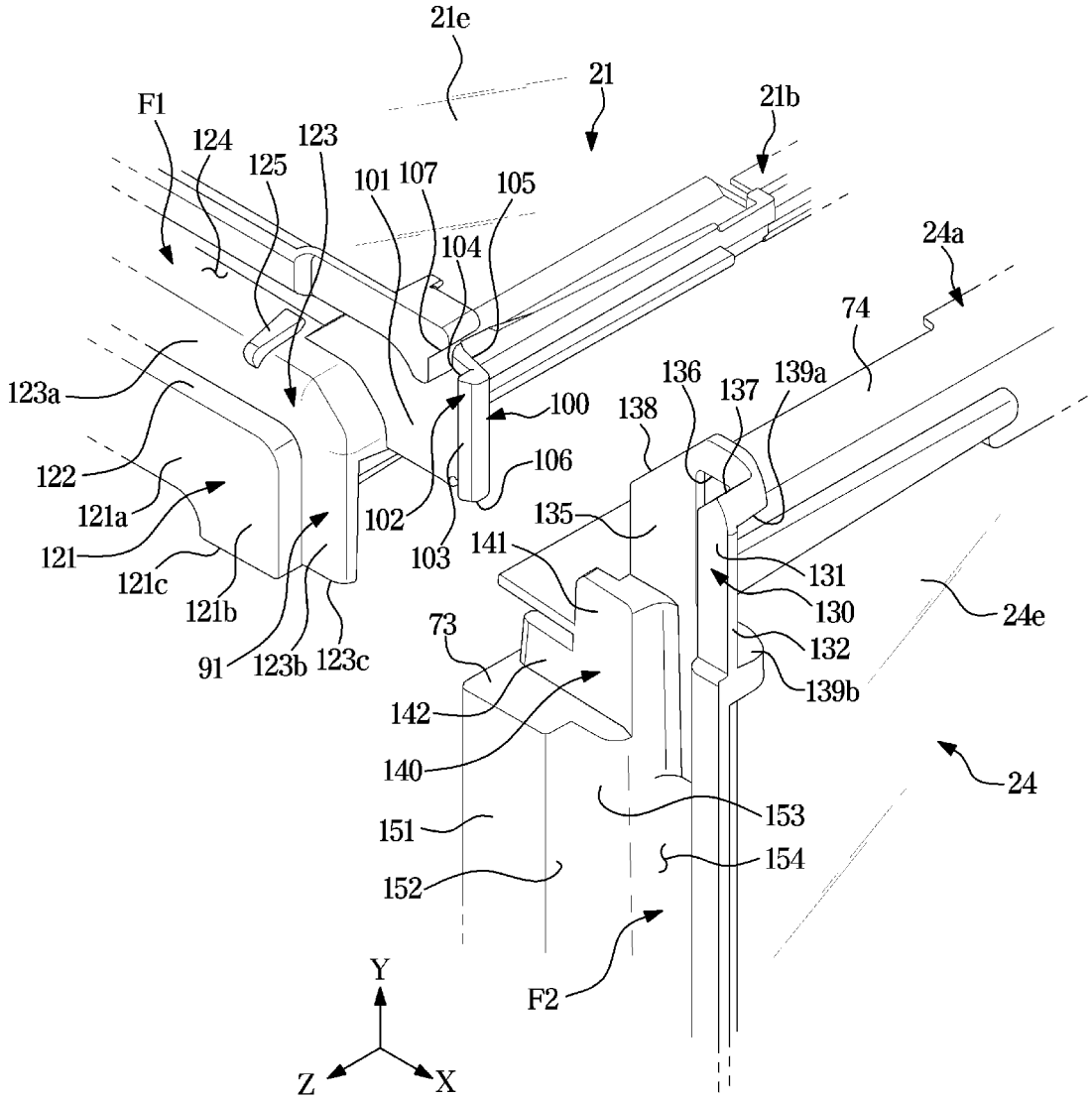
FIG. 7 is a view of a state in which a front flange of a top plate is separated from a front flange of a right plate according to an embodiment of the present disclosure illustrating an area marked by I of FIG. 4.
Figure 9:
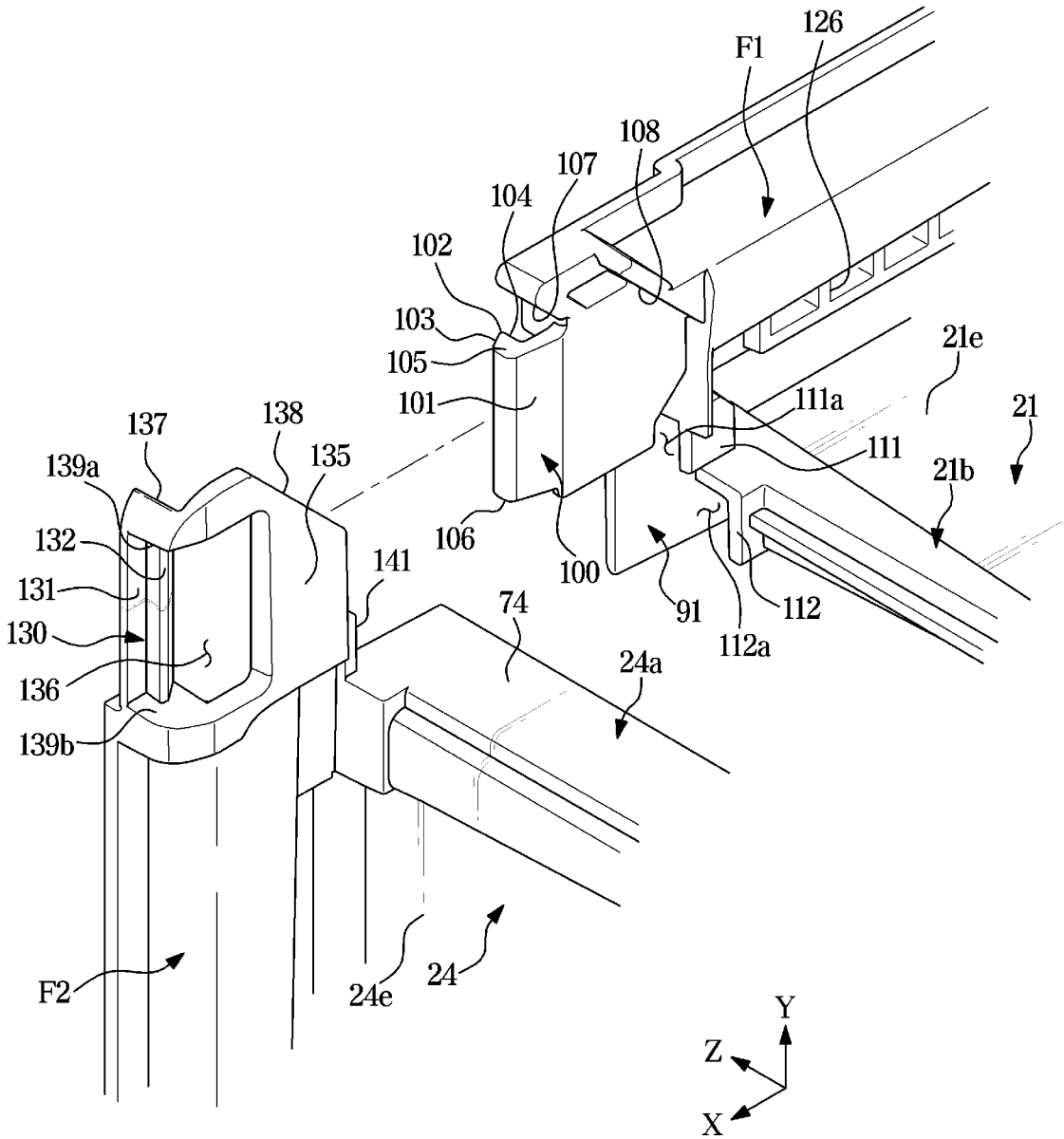
FIG. 9 a view illustrating a state in which the front flange of the top plate is separated from the front flange of the right plate according to an embodiment of the present disclosure at a different angle.

Throughout the specification, right, left, upward, downward, forward, and backward directions may be defined by coordinate axes shown in FIGS. 2, 7, and 9. That is, the +X axis direction of the coordinate axes refers to the right direction, the −X axis direction refers to the left direction, the +Y axis direction refers to the upward direction, the −Y axis direction refers to the downward direction, the +Z axis direction refers to the forward direction, and the −Z axis direction refers to the backward direction.

Hereinafter, embodiments of the present disclosure will be described in detail with reference to the accompanying drawings.

FIG. 1 is a view illustrating an external appearance of a refrigerator according to an embodiment of the present disclosure. FIG. 2 is an exploded view illustrating a first inner case, a second inner case, and an outer case of a refrigerator according to an embodiment of the present disclosure.

Referring to FIGS. 1 and 2, a refrigerator 1 may include a main body 10, storage compartments 29 and 39 formed in the main body 10, doors 2, 3, 4, and 5 opening and closing the storage compartments 29 and 39, and a cool air supply device (not shown) configured to supply cool air to the storage compartments 29 and 39.

The main body 10 may include inner cases 20 and 30 defining the storage compartments 29 and 39, an outer case 11 coupled to outer surfaces of the inner cases 20 and 30 to define an external appearance, and an insulation material 12 (See FIG. 16) interposed between the inner cases 20 and 30 and the outer case 11 to insulate the storage compartments 29 and 39.

The cool air supply device may generate cooling air using a cooling circulation cycle that compresses, condenses, expands, and evaporates a refrigerant and supply the generated cooling air into the storage compartments 29 and 39.

The inner cases 20 and 30 may include a first inner case 20 and a second inner case 30. The first inner case 20 and the second inner case 30 may be fabricated separately and then combined with each other. Each of the first inner case 20 and the second inner case 30 may have a box shape with an open front.

The first storage compartment 29 may be formed in the first inner case 20, and the second storage compartment 39 may be formed in the second inner case 30. The first storage compartment 29 may be used as a refrigerator compartment, and the second storage compartment 39 may be used as a freezer compartment. The second storage compartment 39 may be divided into a plurality of compartments by a vertical partition wall 15. The vertical partition wall 15 may be fabricated separated from the second inner case 30 and then coupled to the second inner case 30. However, the divided form and use of the storage compartments 29 and 39 described above are merely examples, and the embodiment is not limited thereto.

The first inner case 20 may be located at an upper region of the main body 10, and the second inner case 30 may be located at a lower region of the main body 10. However, the positions of the first inner case 20 and the second inner case 30 are not limited thereto, and the first inner case 20 and the second inner case 30 may be aligned in a transverse direction.

Shelves 13 to place food thereon and storage containers 14 to store food may be provided inside the storage compartments 29 and 39.

The first storage compartment 29 may be opened and closed by a pair of doors 2 and 3. The doors 2 and 3 may be pivotally coupled to the main body 10. The second storage compartment 39 may be opened and closed by the doors 4 and 5, and the doors 4 and 5 may be pivotally coupled to the main body 10. Door shelves 6 may be provided at rear surfaces of the doors 2, 3, 4, and 5 to store food. A gasket 7 may be provided at the rim of the rear surface of each of the doors 2, 3, 4, and 5 to be in close contact with the main body 10 to seal the storage compartments 29 and 39.

Figure 3:
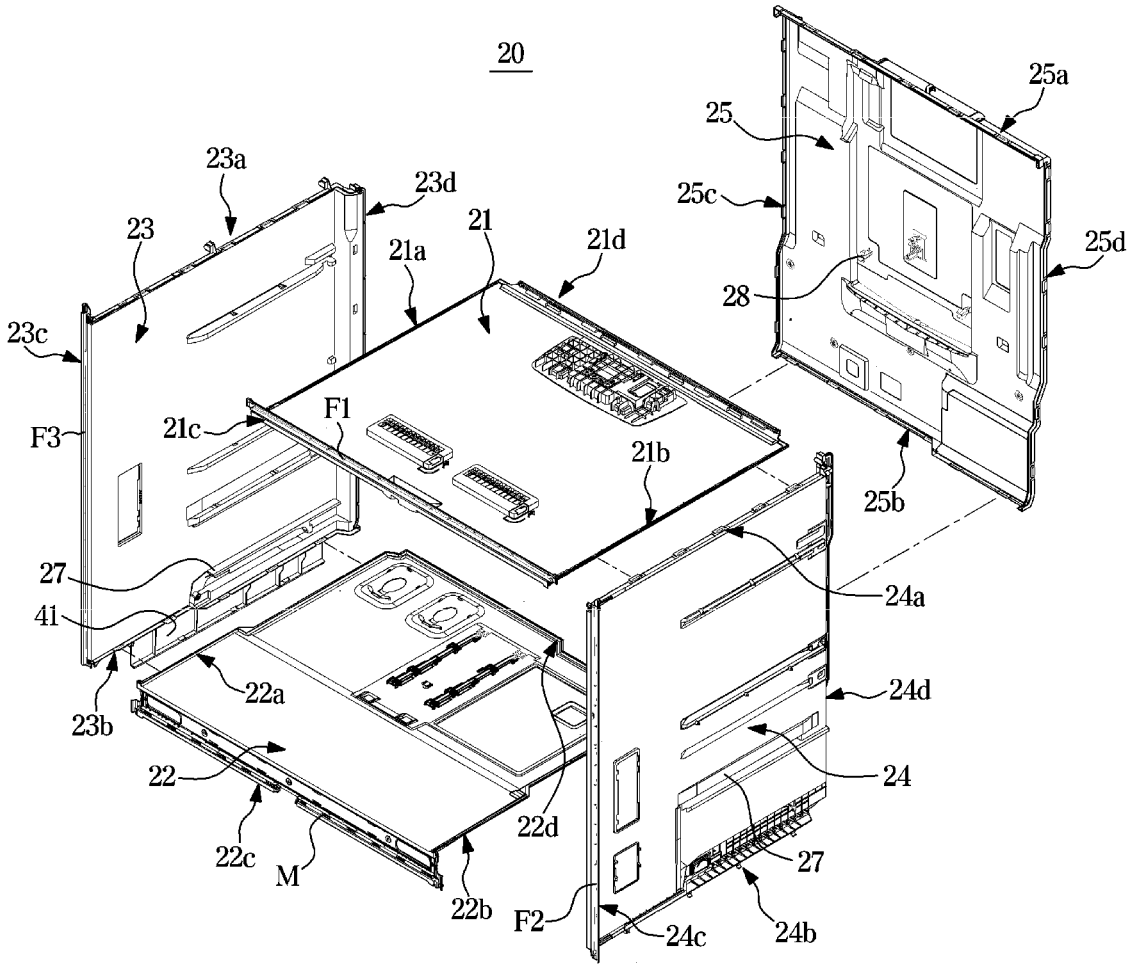
FIG. 3 is an exploded view of a first inner case according to an embodiment of the present disclosure.

FIG. 3 is an exploded view of a first inner case according to an embodiment of the present disclosure.

Referring to FIG. 3, the first inner case 20 according to an embodiment of the present disclosure will be described. Because a structure of the first inner case 20 is not significantly different from that of the second inner case 30, descriptions of the first inner case 20 may also be applied to the second inner case 30.

The first inner case 20 may include a plurality of plates 21, 22, 23, 24, and 25. The first inner case 20 may be formed by assembling the plurality of plates 21, 22, 23, 24, and 25. The plurality of plates 21, 22, 23, 24, and 25 may be coupled to each other without a separate fastening member. That is, each of the plurality of plates 21, 22, 23, 24, and 25 may include a coupler integrally formed for mutual coupling therebetween.

Each of the plurality of plates 21, 22, 23, 24, and 25 may be formed of a resin material by an injection molding method. Each of the plurality of plates 21, 22, 23, 24, and 25 may have 4 edges. The plurality of plates 21, 22, 23, 24, and 25 may include a top plate 21, a bottom plate 22, a left plate 23, a right plate 24, and a rear plate 25.

The top plate 21 may constitute a top surface of the storage compartment 29. The bottom plate 22 may constitute a bottom surface of the storage compartment 29. The left plate 23 may constitute a left surface of storage compartment 29. The right plate 24 may constitute a right surface of the storage compartment 29. The rear plate 25 may constitute a rear surface of the storage compartment 29.

Shapes of the top plate 21, the bottom plate 22, the left plate 23, the right plate 24, and the rear plate 25 are not limited to a flat shape without bending, but the top plate 21, the bottom plate 22, the left plate 23, the right plate 24, and the rear plate 25 may have a curved shape. The top plate 21, the bottom plate 22, the left plate 23, the right plate 24, and the rear plate 25 may have any shape as long as they constitute the top surface, the bottom surface, the left surface, the right surface, and the rear surface of the storage compartment 29, respectively.

In addition, unlike the present embodiment, at least two adjacent plates among the top plate 21, the bottom plate 22, the left plate 23, the right plate 24, and the rear plate 25 may be integrally formed.

That is, unlike the present embodiment, the first inner case 20 may be formed of fewer parts than 5 parts, i.e., the top plate 21, the bottom plate 22, the left plate 23, the right plate 24, and the rear plate 25.

For example, the top plate 21 and the right plate 24 may be integrally injection-molded, or the bottom plate 22 and the left plate 23 may be integrally injection-molded. Alternatively, the top plate 21 and the left plate 23 may be integrally injection-molded or the bottom plate 22 and the right plate 24 may be integrally injection-molded.

As such, even when the first inner case 20 is formed of fewer parts than the above-described 5 parts, i.e., the top plate 21, the bottom plate 22, the left plate 23, the right plate 24, and the rear plate 25, descriptions to be given below may also be applied thereto.

Rails 27 slidably supporting the storage container 14 may be formed on the left plate 23 and the right plate 24. An evaporator fixer 28 capable of fixing an evaporate may be formed at the rear plate 25.

The top plate 21 may include a left edge 21*a*, a right edge 21*b*, a front edge 21*c*, and a rear edge 21*d*.

The bottom plate 22 may include a left edge 22*a*, a right edge 22*b*, a front edge 22*c*, and a rear edge 22*d*

The left plate 23 may include an upper edge 23*a*, a lower edge 23*b*, a front edge 23*c*, and a rear edge 23*d*.

The right plate 24 may include an upper edge 24*a*, a lower edge 24*b*, a front edge 24*c*, and a rear edge 24*d*.

The rear plate 25 may include an upper edge 25*a*, a lower edge 25*b*, a left edge 25*c*, and a right edge 25*d*.

The left edge 21*a* of the top plate 21 may be coupled to the upper edge 23*a* of the left plate 23.

The right edge 21*b* of the top plate 21 may be coupled to the upper edge 24*a* of the right plate 24.

The rear edge 21*d* of the top plate 21 may be coupled to the upper edge 25*a* of the rear plate 25

The left edge 22*a* of the bottom plate 22 may be coupled to the lower edge 23*b* of the left plate 23.

The right edge 22*b* of the bottom plate 22 may be coupled to the lower edge 24*b* of the right plate 24.

The rear edge 22*d* of the bottom plate 22 may be coupled to the lower edge 25*b* of the rear plate 25.

The rear edge 23*d* of the left plate 23 may be coupled to the left edge 25*c* of the rear plate 25.

The rear edge 24*d* of the right plate 24 may be coupled to the right edge 25*d* of the rear plate 25.

As described above, the first inner case 20 may be formed by assembling the edges of the 5 plates 21, 22, 23, 24, and 25 and there may be 8 joints.

A coupler may be formed at the edges for coupling of the edges as described above. A first coupler 50 may be formed at one of the plurality of edges and a second coupler 70 may be formed at the other edge coupled to the former edge (See FIG. 6).

Front flanges F1, F2, and F3 constituting the front surface of the first inner case 20 may be formed at the front edge 21*c* of the top plate 21, at the front edge 23*c* of the left plate 23, and the front edge 24*c* of the right plate 24. A middle connecting plate M may be formed at the front edge 22*c* of the bottom plate 22 to be coupled to a front edge of a top plate 31 of the second inner case 30.

An extension panel 41 may extend from the lower edge 23*b* of the left plate 23. The extension panel 41 may be coupled to a left plate of the second inner case 30. The extension panel 41 may prevent deformation of the inner cases 20 and 30 and the outer case 11 caused by an insulation thickness difference between the first inner case 20 and the outer case 11 and an insulation thickness difference between the second inner case 30 and the outer case 11.

Figure 4:
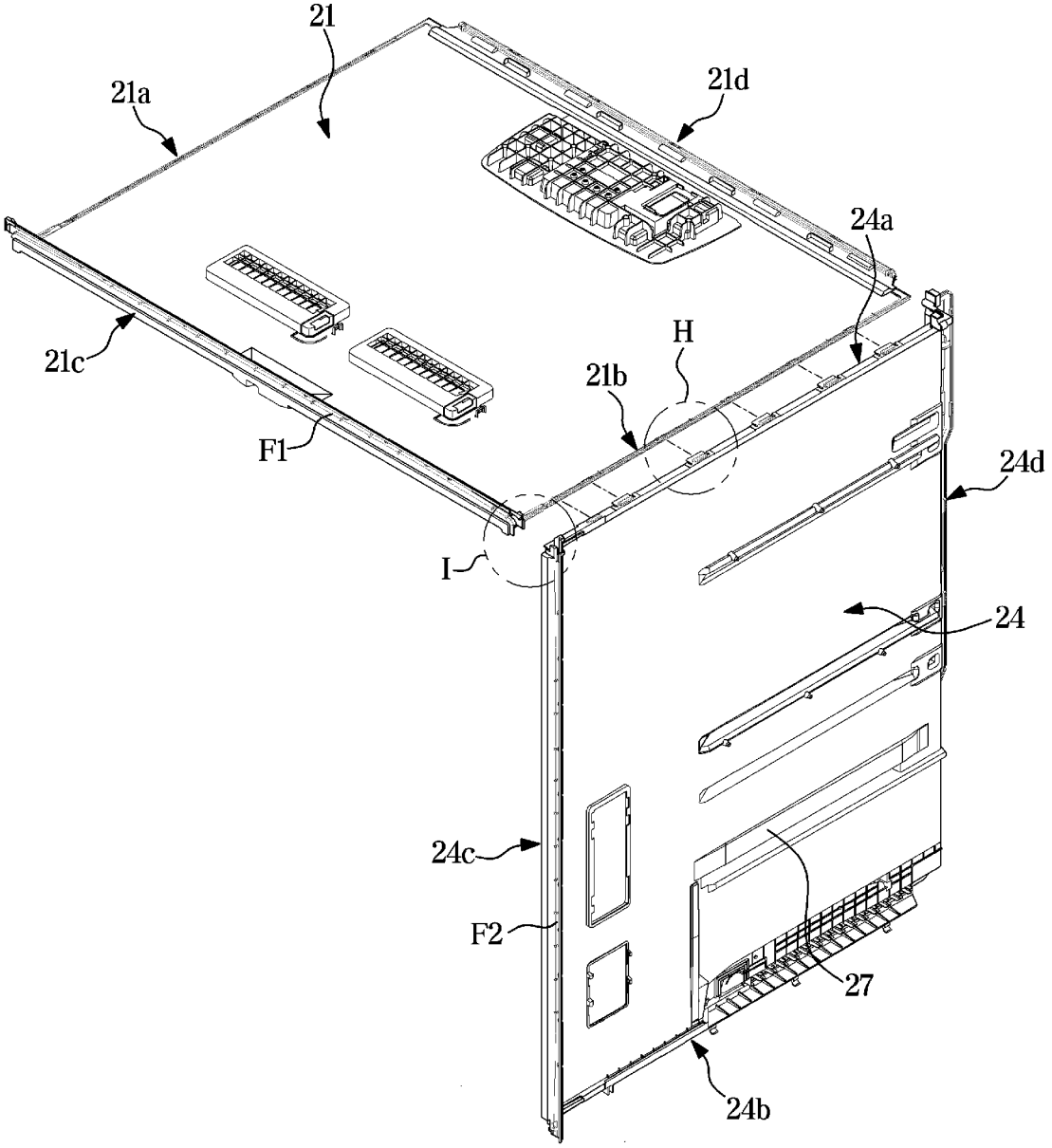
FIG. 4 is a view illustrating a top plate and a right plate according to an embodiment of the present disclosure.
Figure 5:
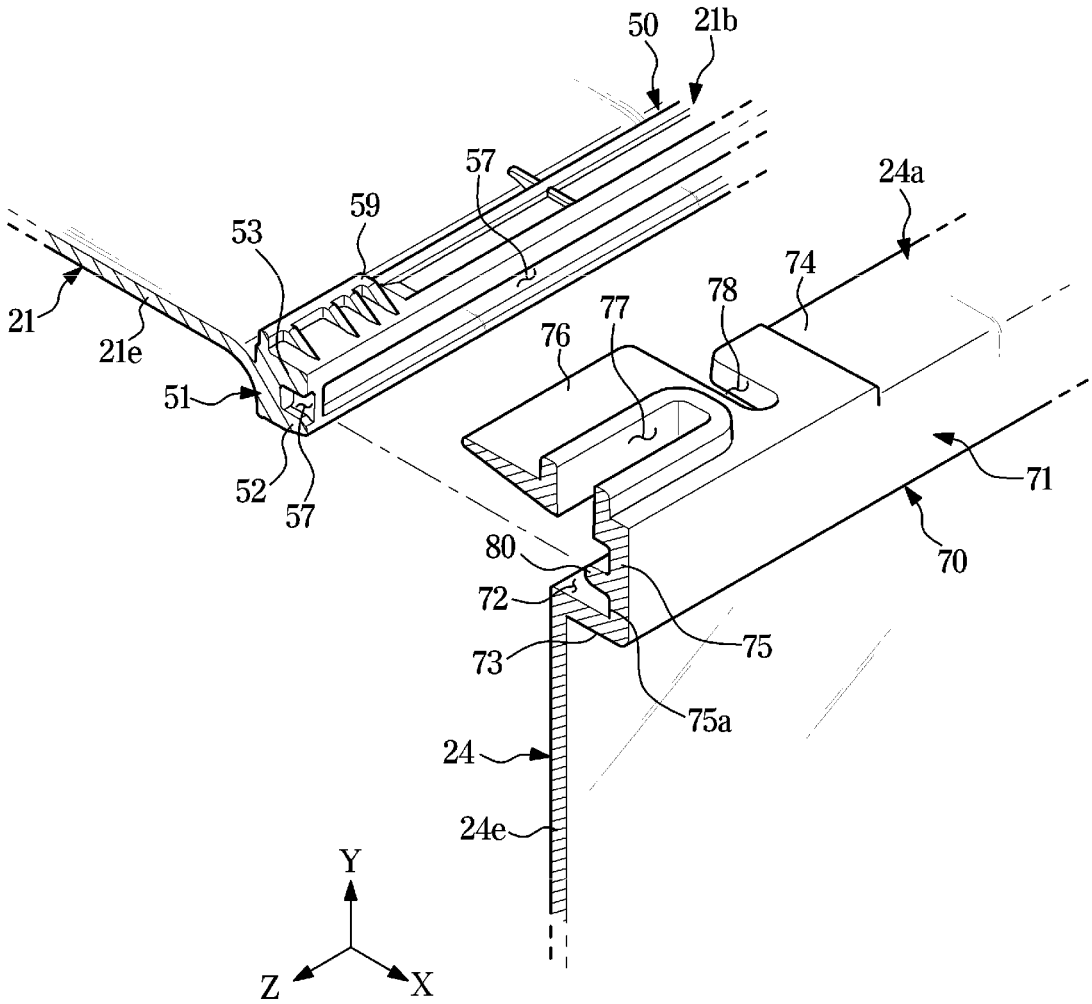
FIG. 5 is a view of a first coupler of a top plate and a second coupler of a right plate according to an embodiment of the present disclosure illustrating an area marked by H of FIG. 4.
Figure 6:
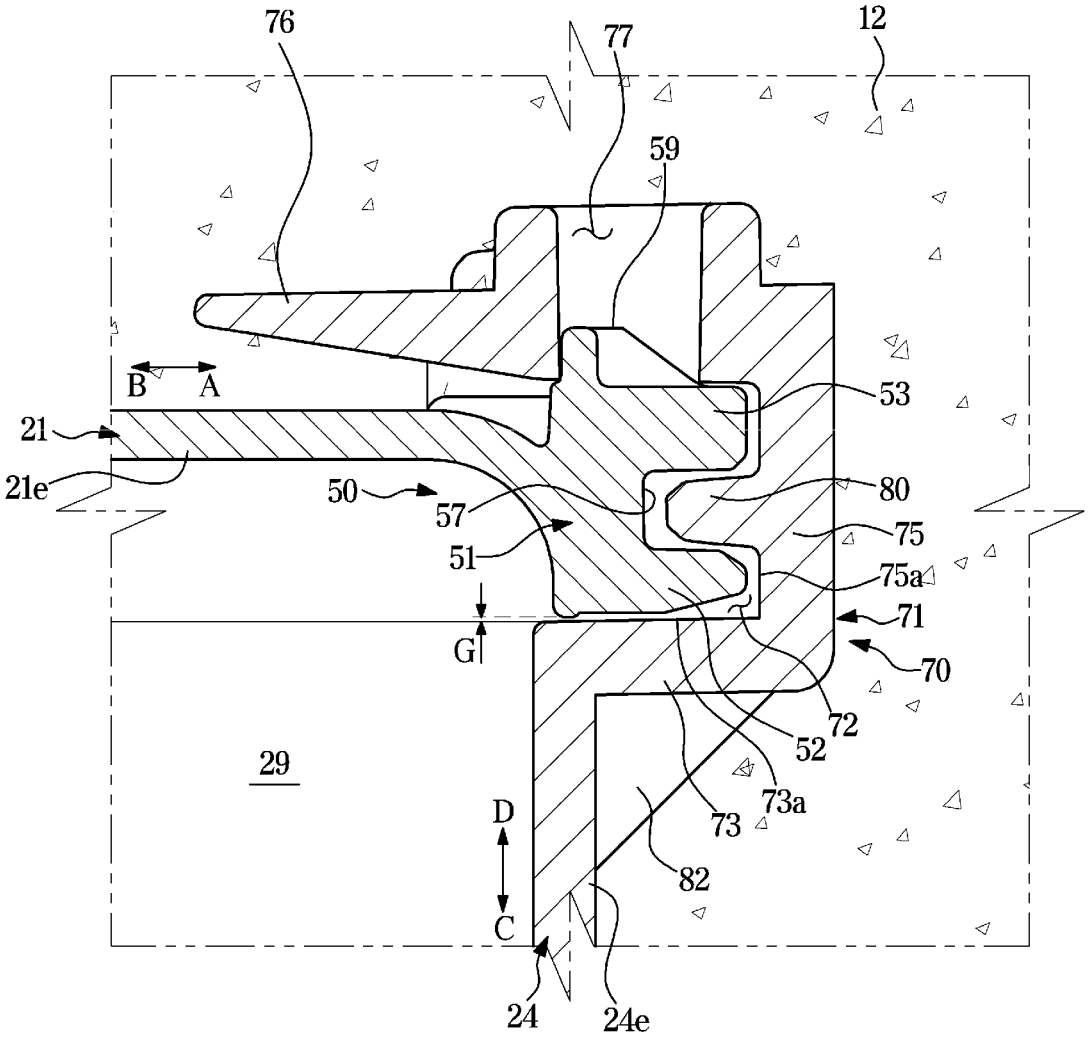
FIG. 6 is a cross-sectional view illustrating a first coupler of a top plate and a second coupler of a right plate according to an embodiment of the present disclosure.

FIG. 4 is a view illustrating a top plate and a right plate according to an embodiment of the present disclosure. FIG. 5 is a view of a first coupler of a top plate and a second coupler of a right plate according to an embodiment of the present disclosure illustrating an area marked by H of FIG. 4. FIG. 6 is a cross-sectional view illustrating a first coupler of a top plate and a second coupler of a right plate according to an embodiment of the present disclosure.

Referring to FIGS. 4 to 6, a coupling structure of the right edge 21*b* of the top plate 21 and the upper edge 24*a* of the right plate 24 will be described.

When the top plate 21 is coupled to the right plate 24, the top plate 21 may be perpendicular to the right plate 24. Once the top plate 21 is coupled to the right plate 24, the right edge 21*b* of the top plate 21 and the upper edge 24*a* of the right plate 24 may face each other in parallel with each other.

For coupling of the right edge 21*b* of the top plate 21 to the upper edge 24*a* of the right plate 24, the first coupler 50 may be formed at the right edge 21*b* of the top plate 21, and the second coupler 70 may be formed at the upper edge 24*a* of the right plate 24.

That is, the top plate 21 may include a top plate body 21*e* and a first coupler 50 formed at the right edge 21*b*. The right plate 24 may include a right plate body 24*e* and the second coupler 70 formed at the upper edge 24*a*.

However, on the contrary, the second coupler 70 may also be formed at the right edge 21*b* of the top plate 21 and the first coupler 50 may also be formed at the upper edge 24*a* of the right plate 24.

The first coupler 50 may be one of various examples of the front coupler. The second coupler 70 may be one of various examples of the second coupler. The structures of the first coupler 50 and the second coupler 70 may be equally applied to edges of the other plates.

The first coupler 50 may include an insertion protrusion 51. The insertion protrusion 51 may protrude from the same plane as the top plate body 21*e* or a plane parallel thereto. The insertion protrusion 51 may be formed to extend along a longitudinal direction of the right edge 21*b*.

The second coupler 70 may include an accommodation structure 71 forming an accommodation groove 72 into which the insertion protrusion 51 is inserted. The accommodation groove 72 may be formed to extend in a longitudinal direction of the upper edge 24*a* to correspond to the insertion protrusion 51.

The accommodation structure 71 may include a first wall 73, a second wall 74, and a third wall 75. The first wall 73, the second wall 74, and the third wall 75 may constitute the accommodation groove 72. The first wall 73 and the second wall 74 may be formed to face each other. The third wall 75 may be formed to connect the first wall 73 with the second wall 74.

The first wall 73 may extend to protrude from the right plate body 24*e* toward the insulation material 12. The first wall 73 may be formed to be perpendicular to the right plate body 24*e*.

The second coupler 70 may include a holder 77 provided to prevent the insertion protrusion 51 from being dislocated from the accommodation groove 72 once the insertion protrusion 51 is inserted into the accommodation groove 72. The insertion protrusion 51 is inserted into the accommodation groove 72 in a first direction A, and the holder 77 may prevent the insertion protrusion 51 from being dislocated in a second location B opposite to the first direction A once the insertion protrusion 51 is inserted into the accommodation groove 72.

In addition, once the insertion protrusion 51 is inserted into the accommodation groove 72, the holder 77 may prevent the insertion protrusion 51 from moving in the longitudinal direction of the upper edge 24*a*.

The second coupler 70 may include an elastic bracket 76 including a holder 77. The elastic bracket 76 may be bent from the third wall 75. A part of the second wall 74 may be cut and the elastic bracket 76 may be disposed at the cut portion of the second wall 74. Slits 78 may be formed at both sides of the elastic bracket 76 to facilitate elastic deformation of the elastic bracket 76. The slits 78 may be formed at both sides of the elastic bracket 76 with respect to the longitudinal direction of the upper edge 24*a*.

During a process of inserting the insertion protrusion 51 into the accommodation groove 72, the elastic bracket 76 may be elastically deformed to be open wider by a pressure applied from the coupling protrusion 59. Once the insertion protrusion 51 is inserted into the accommodation groove 72, the elastic bracket 76 may return to the original state thereof.

The insertion protrusion 51 may include the coupling protrusion 59 provided to be held by the holder 77. The holder 77 may be formed in a hole shape such that the coupling protrusion 59 is held thereby. However, unlike the present embodiment, the holder 77 may also be formed in a groove shape, and may also be formed in a hook shape or any other shapes corresponding to the coupling protrusion 59.

The second coupler 70 may include an inner rib 80 protruding from the accommodation structure 71 and inserted into the insertion protrusion 51 once the insertion protrusion 51 is inserted into the accommodation groove 72. The inner rib 80 may protrude from an inner side surface 75*a* of the third wall 75 toward the accommodation groove 72. The inner rib 80 may be spaced apart from an inner side surface 73*a* of the first wall 73 and an inner side surface of the second wall 74.

The inner rib 80 may protrude in the second direction B opposite to the first direction A in which the insertion protrusion 51 is inserted. Therefore, the inner rib 80 may be naturally inserted into the insertion protrusion 51 during a process of inserting the insertion protrusion 51 into the accommodation groove 72.

By providing the inner rib 80 at the accommodation structure 71 as described above, deformation of the first inner case 20 may be prevented while the first inner case 20 thermally shrinks due to low temperature of the first storage compartment 29 and formation of a gap G between the first coupler 50 and the second coupler 70 may be prevented.

When a low temperature is applied to the right plate 24, the right plate 24 may thermally shrink in a third direction C. The third direction C may be perpendicular to both the first direction A and the second direction B.

In this case, the inner rib 80 may be supported by the insertion protrusion 51 in a fourth direction D opposite to the third direction C. In addition, the inner rib 80 may press the insertion protrusion 51 in the third direction C. Therefore, shrinking deformation of the right plate 24 may be prevented, and thus formation of a gap G between the insertion protrusion 51 and the inner surface 73*a* of the first wall 73 may be prevented.

The insertion protrusion 51 may include a rib groove 57 into which the inner rib 80 is inserted. The rib groove 57 may be formed at the insertion protrusion 51 in a recessed form. The insertion protrusion 51 may include a first region 52 formed between the inner rib 80 and the first wall 73 and a second region 53 formed between the inner rib 80 and the second wall 74.

As described above, the inner rib 80 may prevent thermal deformation of the inner case 20 and prevent formation of a gap between the couplers, and furthermore may improve airtightness between the couplers.

The inner rib 80 may extend in the longitudinal direction of the upper edge 24*a*. The rib groove 57 may extend in the longitudinal direction of the right edge 21*b*.

The second coupler 70 may include an outer rib 82 provided at an outer portion of the accommodation structure 71 to support the first wall 73. The outer rib 82 may be integrally formed with the right plate 24. The outer rib 82 may be formed in a triangular shape. A plurality of outer ribs 82 may be provided, and the plurality of outer ribs 82 may be formed to be spaced apart from each other in the longitudinal direction of the upper edge 24*a*.

By forming the outer rib 82 as described above, the thermal deformation of the first inner case 20 and gap formation between the couplers may further be prevented.

Figure 8:
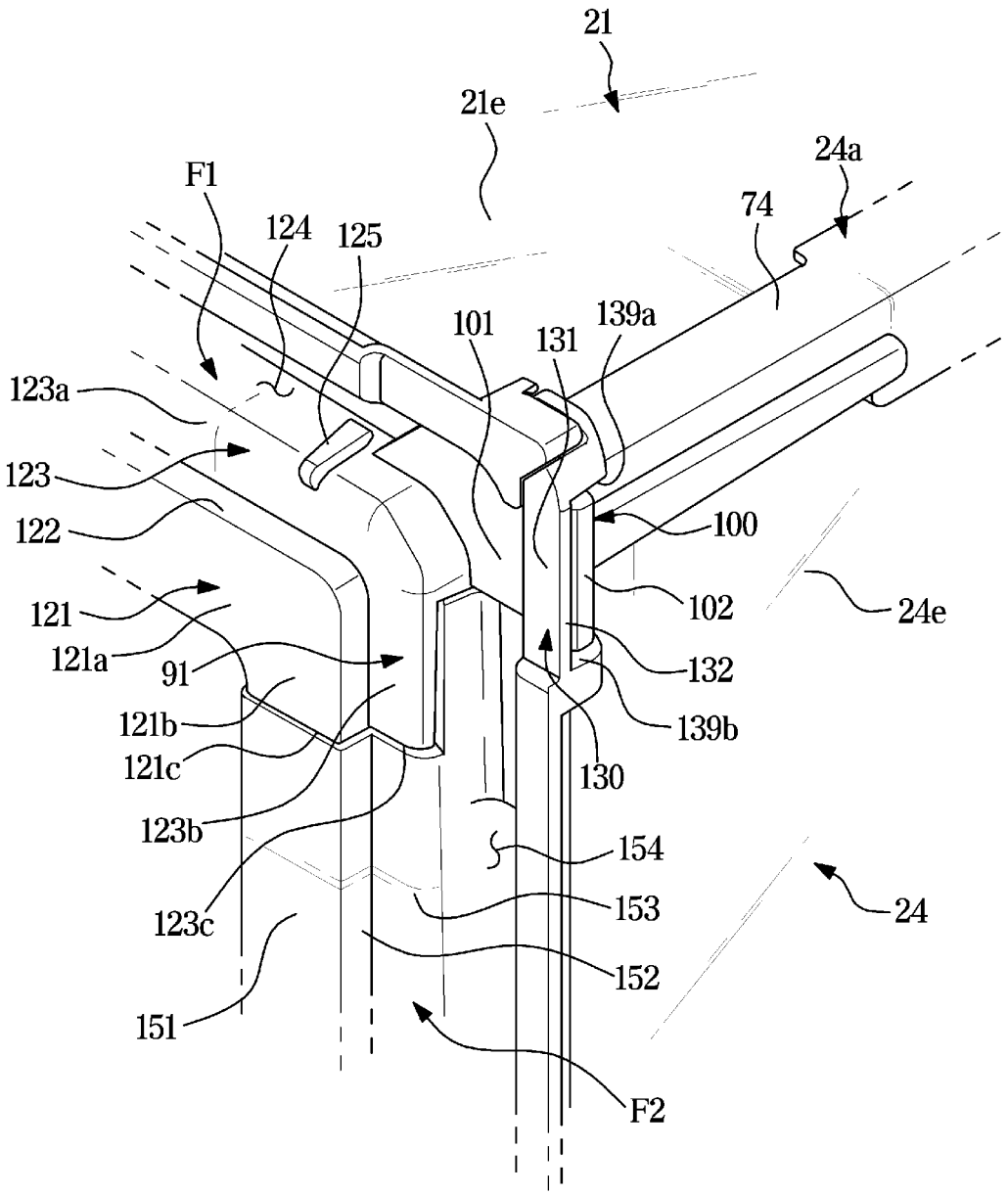
FIG. 8 is a view illustrating a state in which the front flange of the top plate is coupled to the front flange of the right plate according to an embodiment of the present disclosure.
Figure 10:
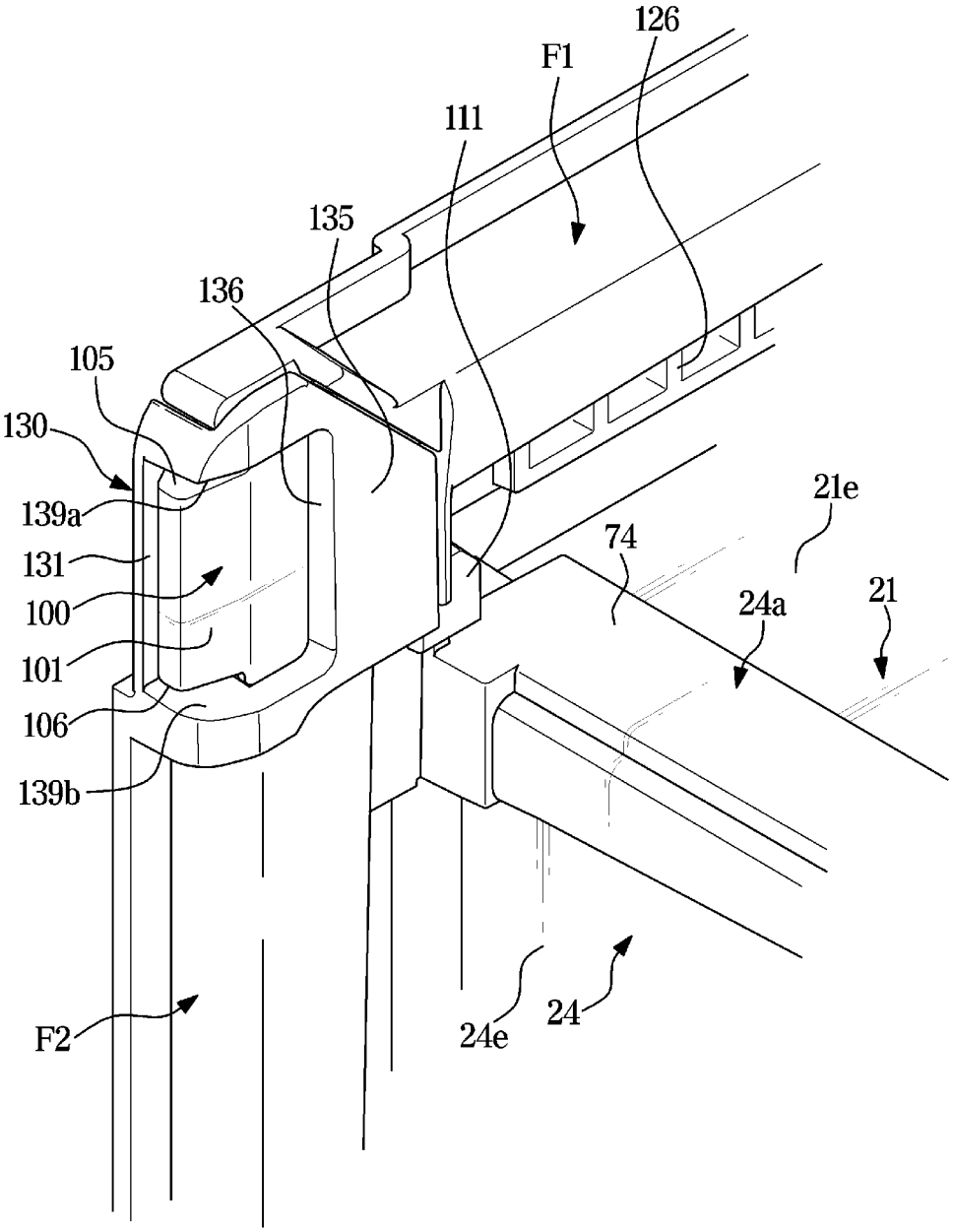
FIG. 10 is a view illustrating a state in which the front flange of the top plate is coupled to the front flange of the right plate according to an embodiment of the present disclosure at a different angle.
Figure 11:
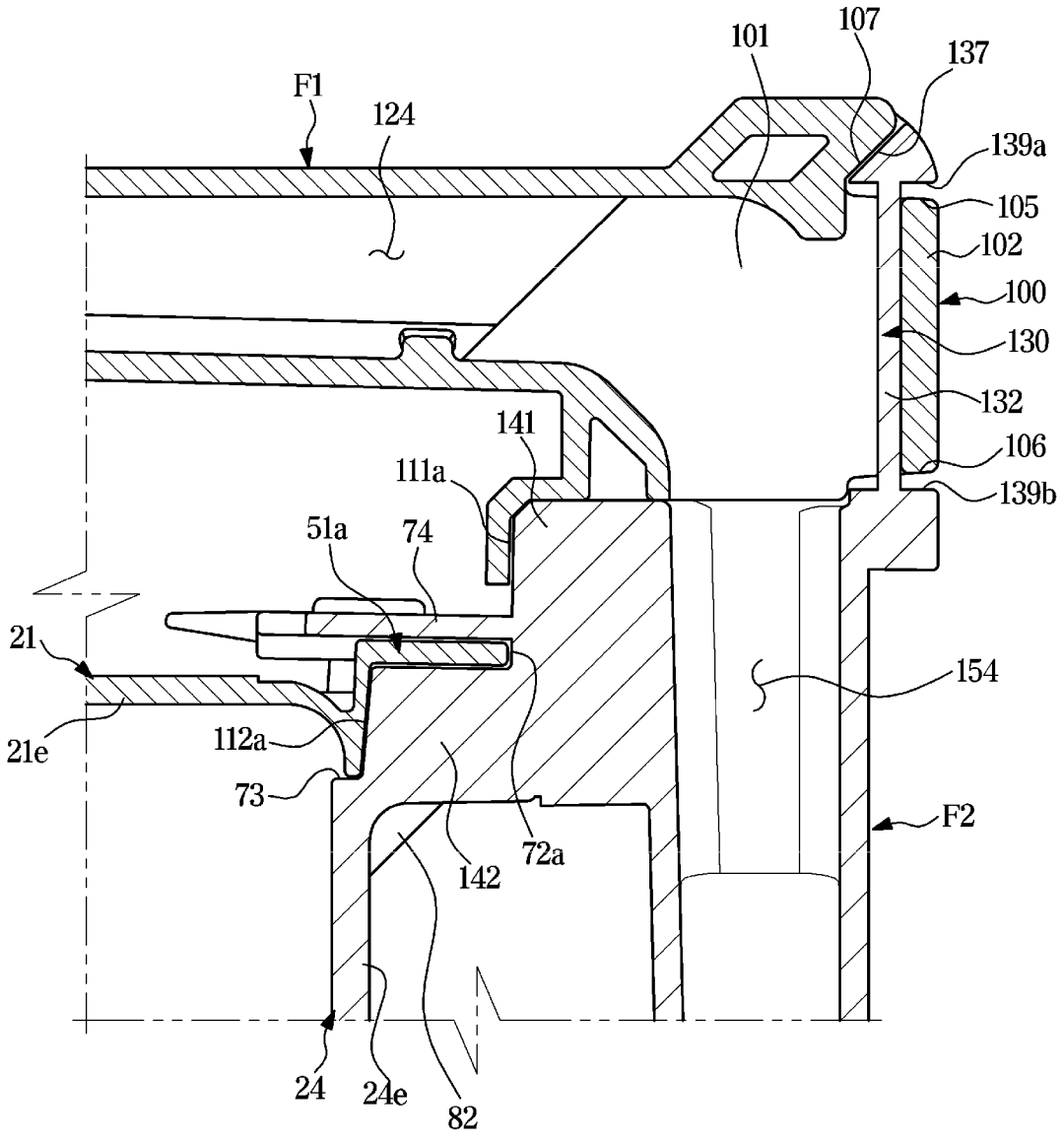
FIG. 11 is a longitudinal cross-sectional view illustrating a state in which the front flange of the top plate is coupled to the front flange of the right plate according to an embodiment of the present disclosure.
Figure 12:
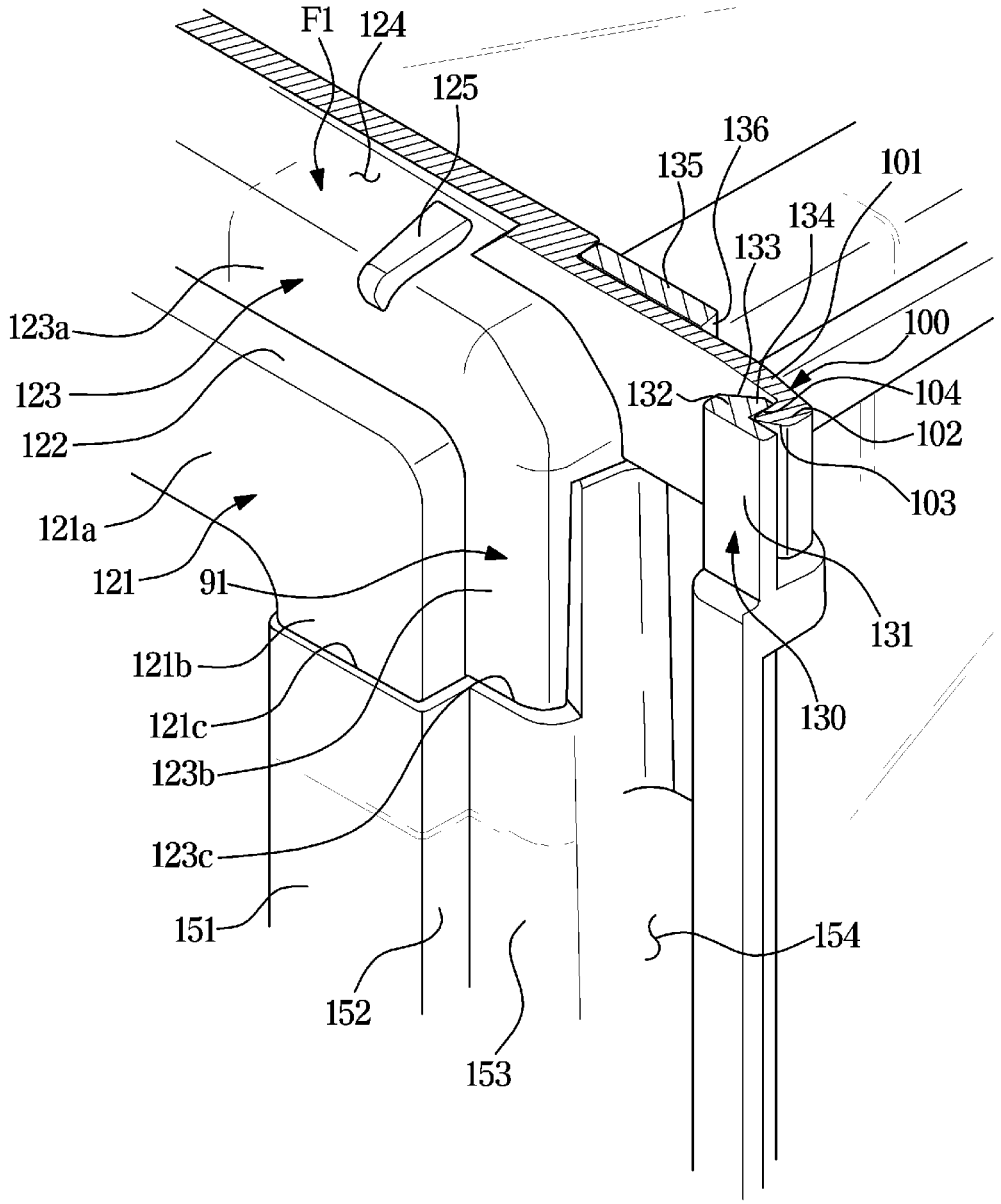
FIG. 12 is a transverse cross-sectional view illustrating a hook coupler and a hook holder in a state where the front flange of the top plate is coupled to the front flange of the right plate according to an embodiment of the present disclosure.
Figure 13:
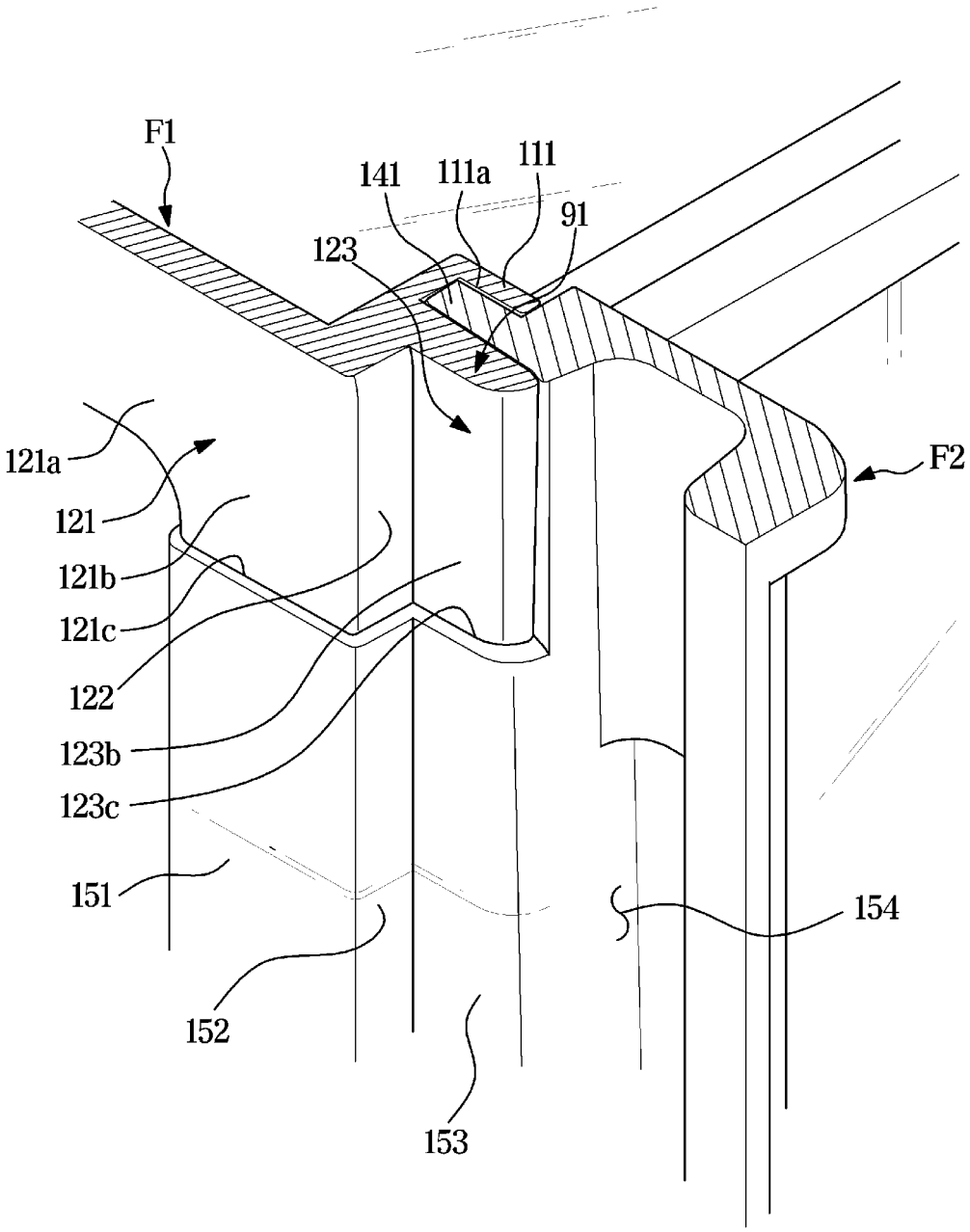
FIG. 13 is a transverse cross-sectional view illustrating an upper movement prevention protrusion in a state where the front flange of the top plate is coupled to the front flange of the right plate according to an embodiment of the present disclosure.
Figure 14:
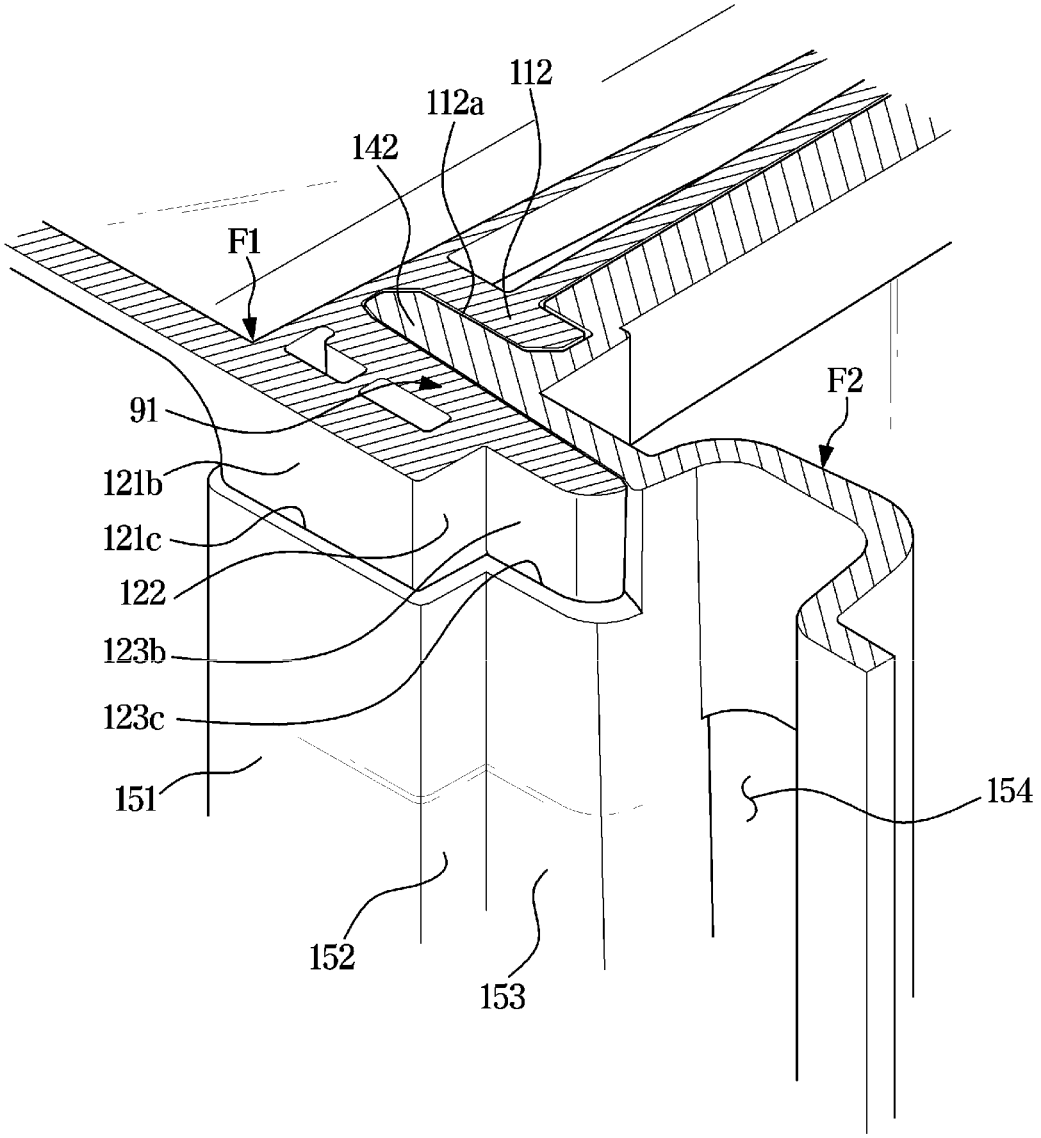
FIG. 14 is a transverse cross-sectional view illustrating a lower movement prevention protrusion in a state where the front flange of the top plate is coupled to the front flange of the right plate according to an embodiment of the present disclosure.
Figure 15:
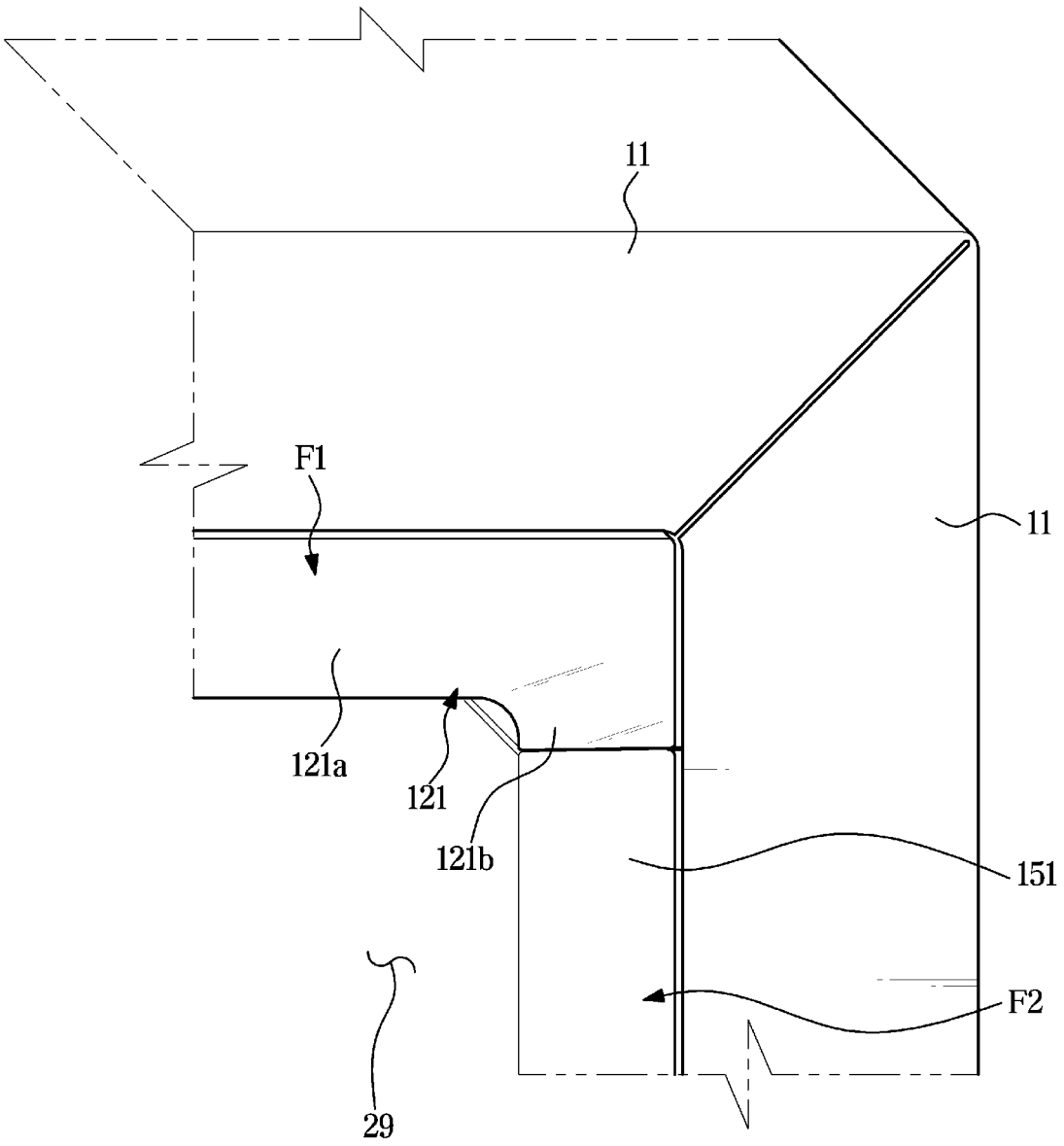
FIG. 15 is a view illustrating a state in which an inner case is coupled to an outer case according to an embodiment of the present disclosure.
Figure 16:
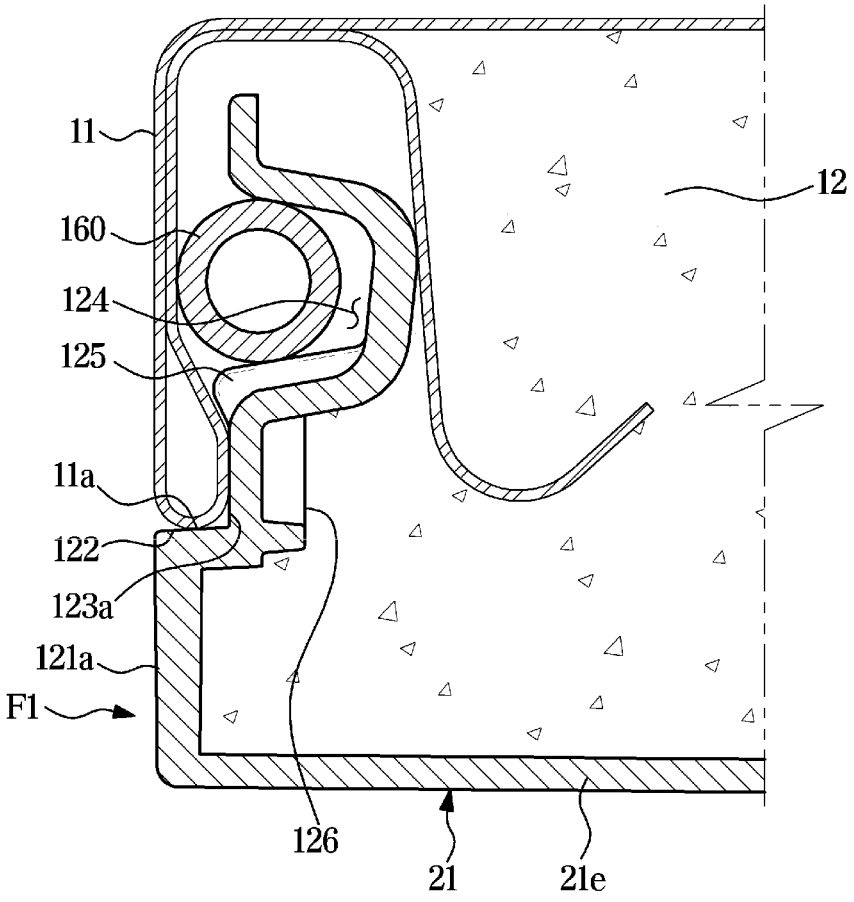
FIG. 16 is a cross-sectional view illustrating a state in which an inner case is coupled to an outer case according to an embodiment of the present disclosure.

FIG. 7 is a view of a state in which a front flange of a top plate is separated from a front flange of a right plate according to an embodiment of the present disclosure illustrating an area marked by I of FIG. 4. FIG. 8 is a view illustrating a state in which the front flange of the top plate is coupled to the front flange of the right plate according to an embodiment of the present disclosure. FIG. 9 a view illustrating a state in which the front flange of the top plate is separated from the front flange of the right plate according to an embodiment of the present disclosure at a different angle. FIG. 10 is a view illustrating a state in which the front flange of the top plate is coupled to the front flange of the right plate according to an embodiment of the present disclosure at a different angle. FIG. 11 is a longitudinal cross-sectional view illustrating a state in which the front flange of the top plate is coupled to the front flange of the right plate according to an embodiment of the present disclosure. FIG. 12 is a transverse cross-sectional view illustrating a hook coupler and a hook holder in a state where the front flange of the top plate is coupled to the front flange of the right plate according to an embodiment of the present disclosure. FIG. 13 is a transverse cross-sectional view illustrating an upper movement prevention protrusion in a state where the front flange of the top plate is coupled to the front flange of the right plate according to an embodiment of the present disclosure. FIG. 14 is a transverse cross-sectional view illustrating a lower movement prevention protrusion in a state where the front flange of the top plate is coupled to the front flange of the right plate according to an embodiment of the present disclosure. FIG. 15 is a view illustrating a state in which an inner case is coupled to an outer case according to an embodiment of the present disclosure. FIG. 16 is a cross-sectional view illustrating a state in which an inner case is coupled to an outer case according to an embodiment of the present disclosure.

Referring to FIGS. 7 to 16, a coupling structure of the front flange F1 of the top plate 21 and the front flange F2 of the right plate 24 according to an embodiment of the present disclosure will be described. The following descriptions may be equally applied to a coupling structure of front flanges of other plates. Hereinafter, the front flange F1 of the top plate 21 may be referred to as first front flange F1 and the front flange F2 of the right plate 24 may be referred to as second front flange F2.

The first front flange F1 may be integrally formed with the top plate 21 by injection molding. The first front flange F1 may constitute a part of the front surface of the inner case 20. The first front flange F1 may protrude upward from the body 21*e* of the top plate 21. The first front flange F1 may have a shape extending in a transverse direction.

As shown in FIGS. 15 and 16, the first front flange F1 may include a first exposed surface 121 defining a part of the front surface of the main body 10, and a first outer case support surface 123 formed to be stepped from the first exposed surface 121 to support the outer case 11. The first exposed surface 121 and the first outer case support surface 123 may be formed to be parallel to each other.

The first exposed surface 121 may include a first surface 121*a* of the first exposed surface 121 extending in the horizontal direction, and a second surface 121*b* of the first exposed surface 121 extending in the vertical direction from one end of the first surface 121*a* of the first exposed surface 121.

The first outer case support surface 123 may include a first surface 123*a* of the first outer case support surface 123 extending in the horizontal direction, and a second surface 123*b* of the first outer case support surface 123 extending in the vertical direction from one end of the first surface 123*a* of the first outer case support surface 123.

A lower end 121*c* of the second surface 121*b* of the first exposed surface 121 may be located at a height corresponding to a lower end 123*c* of the second surface 123*b* of the first outer case support surface 123.

By the above-described configuration, around a rectangular corer, the two surfaces 123*a* and 123*b* of the first front flange F1 may be supported by the outer case 11. Therefore, a forward and backward movement of the first front flange F1 is limited, and a step difference and gap between the first front flange F1 and the second front flange F2 in the forward and backward direction may be reduced.

The first front flange F1 may include a first end support surface 122 connecting the first exposed surface 121 with the first outer case support surface 123 and supporting an inner end 11*a* (FIG. 16) of the outer case 11.

The first front flange F1 may include a first mounting groove 124, on which a hot pipe 160 (FIG. 16) to prevent formation of dew on the outer case 11, is mounted. The first mounting groove 124 may be provided with a mounting rib 125 to support the outer case 11 and the hot pipe 160. A reinforcement rib 127 to reinforce rigidity of the first front flange F1 may be formed on the rear surface of the first front flange F1.

Once the outer case 11 is coupled to the first front flange F1, the first exposed surface 121 may be exposed forward, and the first outer case support surface 123 and the first mounting groove 124 may be covered by the outer case 11.

The second front flange F2 may be integrally formed with the right plate 24 by injection molding. The second front flange F2 may constitute another part of the front surface of the inner case 20. The second front flange F2 may protrude to the right from the body 24*e* of the right plate 24. The second front flange F2 may have a shape extending in a longitudinal direction.

The second front flange F2 may include a second exposed surface 151 defining a part of the front surface of the main body 10, and a second outer case support surface 153 formed to be stepped from the second exposed surface 151 to support the outer case 11. The second exposed surface 151 and the second outer case support surface 153 may be formed to be parallel to each other.

The second front flange F2 may include a second end support surface 152 connecting the second exposed surface 151 with the second outer case support surface 153 and supporting the inner end 11*a* of the outer case 11. The second front flange F2 may include a second mounting groove 154, on which a hot pipe 160 to prevent formation of dew on the outer case 11, is mounted.

Once the outer case 11 is coupled to the second front flange F2, the second exposed surface 151 may be exposed forward, and the second outer case support surface 153 and the second mounting groove 154 may be covered by the outer case 11.

The first front flange F1 may be coupled to the second front flange F2. The first front flange F1 may be coupled to the second front flange F2 in a transverse direction. That is, by moving the first front flange F1 to the right or by moving the second front flange F2 to the left, the first front flange F1 may be coupled to the second front flange F2.

The first front flange F1 may be coupled to the second front flange F2 simultaneously as the first coupler 50 is coupled to the second coupler 70.

That is, by moving the top plate 21 and the right plate 24 to be closer in a transverse direction, the first coupler 50 of the top plate 21 may be coupled to the second coupler 70 of the right plate 24 simultaneously with coupling of the first front flange F1 of the top plate 21 and the second front flange F2 of the right plate 24. Therefore, a plurality of plates, such as the top plate 21 and the right plate 24, constituting the first inner case 20 may be easily assembled.

The first front flange F1 may be coupled to the second front flange F2 without using a separate fastening member. The first front flange F1 may be coupled to the second front flange F2 by a hook coupling method. To this end, a hook coupler 100 may be provided at the first front flange F1 and a hook holder 130 may be provided at the second front flange F2. The hook coupler 100 may be coupled to the hook holder 130 by a hook coupling method.

The hook coupler 100 may be integrally formed with the first front flange F1 by injection molding. The hook holder 130 may be integrally formed with the second front flange F2 by injection molding.

The hook coupler 100 may be provided at an upper portion of the first front flange F1. The hook coupler 100 may include a hook body 101 protruding from the first front flange F1 and a hook protrusion 102 formed at one end of the hook body 101. The hook body 101 may be elastically deformed during coupling. A part of the first mounting groove 124 may be formed at the front surface of the hook body 101.

The hook holder 130 may include a holder body 131 and a holding protrusion 132 protruding from the holder body 131 to be caught by the hook protrusion 102.

The hook protrusion 102 may include an inclined slide surface 103. The hook protrusion 102 may include a hook surface 104. The holding protrusion 132 may include a guide surface 133 inclined to guide the slide surface 103 to slide while the hook coupler 100 is coupled to the hook holder 130. The holding protrusion 132 may include a holding surface 134 provided to be caught by the hook surface 104.

During a process of guiding the slide surface 103 by the guide surface 133, the hook body 101 may be elastically deformed to move backward (−Z axis direction). When the slide surface 103 is spaced apart from the guide surface 133 by moving the hook protrusion 102 by a predetermined distance, the hook surface 104 is held by the holding surface 134 while the hook body 102 returns to the original state. The hook surface 104 is held by the holding surface 134, and dislocation of the hook coupler 100 in a direction opposite to the coupling direction (−X axis direction, leftward) may be prevented.

Once the hook coupler 100 is coupled to the hook holder 130, the front surface of the hook body 101 may be supported by the holder body 131. Therefore, dislocation of the hook coupler 100 in the forward direction (+Z axis direction) may be prevented.

The hook holder 130 may include a rear support 135 disposed behind the hook body 101 to support the rear surface of the hook body 101. Therefore, the hook body 101 and the rear support 135 may overlap each other in the forward and backward direction.

Once the hook coupler 100 is coupled to the hook holder 130, the rear surface of the hook body 101 is supported by the rear support 135 and thus dislocation of the hook coupler 100 backward (−Z axis direction) may be prevented.

The rear support 135 may have an opening 136 such that the hook body 101 may be elastically deformed in the −Z axis direction. That is, when the hook body 101 is elastically deformed during a process of coupling the hook coupler 100 with the hook holder 130, the hook body 101 may pass through the opening 136 or may be accommodated in the opening 136.

The hook holder 130 may further include an upper support 139*a* to support a top surface 105 of the hook protrusion 102 and a lower support 139*b* to support a bottom surface 106 of the hook protrusion 102. The upper support 139*a* and the lower support 139*b* may be formed at the upper end and the lower end of the holder body 131, respectively. Once the hook coupler 100 is coupled to the hook holder 130, dislocation of the hook coupler 100 in the upward or downward direction (+Y axis direction or −Y axis direction) may be prevented by the upper support 139*a* and the lower support 139*b*.

The hook coupler 100 may include slopes 107 and 108 that are inclined upward to the right. The hook holder 130 may include slope support surfaces 137 and 138 that are inclined to support the slopes 107 and 108. The slope support surface 137 is formed at an upper portion of the holder body 131, and the slope support surface 138 may be formed by cutting the upper end of the rear support 135. The slopes 107 and 108 may be formed at positions respectively corresponding to the slope support surfaces 137 and 138. However, the positions of the slopes 107 and 108 and the slope support surfaces 137 and 138 are not limited thereto.

Because the slopes 107 and 108 and the slope support surfaces 137 and 138 support each other in contact with each other, movement of the hook coupler 100 to the right (+X axis direction) or movement thereof downward (−Y axis direction) may be prevented.

As described above, the hook coupler 100 and the hook holder 130 may be fixed in directions of three axes, in the X axis, Y axis, and Z axis.

The first front flange F1 may include an insertion protrusion 51*a* (FIG. 11) corresponding to the insertion protrusion 51 of the first coupler 50. The second front flange F2 may include an accommodation groove 72*a* (FIG. 11) corresponding to the accommodation groove 72 of the second coupler 70. The insertion protrusion 51*a* may be inserted into the accommodation groove 72*a*.

The second front flange F2 may include a movement prevention protrusion 140 inserted into the first front flange F1 to support the first front flange F1 in the forward and backward direction (+Z axis and −Z axis direction). The movement prevention protrusion 140 may be disposed at a lower portion of the hook holder 130. The movement prevention protrusion 140 may prevent movement of a lower part 91 of the first front flange F1 in the forward and backward direction. The lower part 91 of the first front flange F1 may partially overlap the movement prevention protrusion 140 in the forward and backward direction.

The movement prevention protrusion 140 may include an upper movement prevention protrusion 141 located at an upper portion of the second wall 74 and a lower movement prevention protrusion 142 located at a lower portion of the second wall 74. The lower movement prevention protrusion 142 may extend closer to the first front flange F1 than the upper movement prevention protrusion 141.

The first front flange F1 may include movement prevention grooves 111*a* and 112*a* into which the upper and lower movement prevention protrusions 141 and 142 are inserted (See FIG. 9). The movement prevention grooves 111*a* and 112*a* may be formed at the rear surface of the lower part 91 of the first front flange F1. The first front flange F1 may include movement prevention walls 111 and 112 protruding from the rear surface of the lower part 91 of the first front flange F1 to form the movement prevention grooves 111*a* and 112*a*.

A part of the first exposed surface 121 may be formed at the front surface of the lower part 91 of the first front flange F1. A part of the first outer case support surface 123 may be formed at the front surface of the lower part 91 of the first front flange F1.

As described above, by inserting the movement prevention protrusions 141 and 142 of the second front flange F2 into the movement prevention grooves 111*a* and 112*a* of the first front flange F1, movement of the first front flange F1 in the forward and backward direction may further be prevented.

Based on the configuration, according to an embodiment of the present disclosure, a gap and a step difference between the first front flange F1 and the second front flange F2 in the forward and backward direction caused by production and assembly errors and foaming pressure applied while foaming the insulation material may be reduced and coupling force between the first front flange F1 and the second front flange F2 may be enhanced.

The structure of the inner case according to the above-described embodiments may also be applied to various home appliances such as clothing care apparatuses, shoe care apparatuses, cooking apparatuses, dishwashers, and air conditioners as well as the refrigerator.

That is, a home appliance may include a main body having an interior space to perform a predetermined function with an open front and a door coupled to the main body to open and close the open front of the interior space. The main body of the home appliance may include an inner case, an outer case, and an insulation material interposed between the inner case and the outer case, and the inner case according to the above-described embodiment may be applied to the inner case of the main body of the home appliance.

The embodiments of the present disclosure have been shown and described above with reference to the accompanying drawings. It will be understood by those of ordinary skill in the art that the present disclosure may be easily modified into other detailed forms without changing the technical principle or essential features of the present disclosure. However, the disclosed embodiments are illustrative and the scope of the present disclosure is not limited thereby.

What is claimed is:

1. A refrigerator comprising:

an inner case forming a storage compartment and including a plurality of plates respectively formed by injection molding;

an outer case coupled with the inner case; and an insulation material interposed between the inner case and the outer case, wherein a first plate among the plurality of plates includes a first front flange forming a part of a front surface of the inner case, a second plate among the plurality of plates includes a second front flange forming another part of the front surface of the inner case, and couplable to the first front flange, the second front flange includes a movement prevention protrusion insertable into the first front flange to support the first front flange along a forward and backward direction, and the movement prevention protrusion includes an upper movement prevention protrusion and a lower movement prevention protrusion, the lower movement prevention protrusion extending into the first front flange a greater distance than the upper movement prevention protrusion.

2. The refrigerator according to claim 1, wherein
the first front flange comprises a hook coupler,
the second front flange includes a hook holder, and
the hook coupler is coupled to the hook holder by hooking the hook coupler to the hook holder.

3. The refrigerator according to claim 2, wherein the hook coupler comprises
a hook body formed to protrude from the first front flange and being elastically deformable, and
a hook protrusion formed at one end of the hook body, wherein the hook holder includes a holder body, and
a holding protrusion formed to be caught by the hook protrusion.

4. The refrigerator according to claim 3, wherein the hook body is supported by a rear surface of the holder body while the hook coupler is coupled to the hook holder.

5. The refrigerator according to claim 3, wherein
the hook holder comprises
a rear support disposed behind the hook body to support the hook body, and
the rear support includes an opening to guide elastic deformation of the hook body.

6. The refrigerator according to claim 3, wherein the hook holder comprises an upper support to support a top surface of the hook protrusion and a lower support to support a bottom surface of the hook protrusion.

7. The refrigerator according to claim 2, wherein
the hook coupler is formed with a slope inclined upward and toward the hook holder, and
the hook holder comprises a slope support surface inclined to support the slope.

8. The refrigerator according to claim 1, wherein the first front flange comprises a movement prevention groove into which the movement prevention protrusion is insertable.

9. The refrigerator according to claim 1, wherein
the first front flange comprises:
a first exposed surface forming a part of a front surface of a main body of the refrigerator,
a first outer case support surface formed to be stepped from the first exposed surface to support the outer case, and
a first mounting groove on which a hot pipe to prevent formation of dew on the outer case is mountable; and
the second front flange comprises:
a second exposed surface defining another part of the front surface of the main body of the refrigerator,
a second outer case support surface formed to be stepped from the second exposed surface to support the outer case, and
a second mounting groove on which the hot pipe is mountable.

10. The refrigerator according to claim 9, wherein
the first exposed surface comprises a first surface of the first exposed surface formed to extend along a horizontal direction of the refrigerator, and
a second surface of the first exposed surface formed to extend from one end of the first surface of the first exposed surface along a vertical direction of the refrigerator.

11. The refrigerator according to claim 10, wherein
the first outer case support surface comprises a first surface of the first outer case support surface formed to extend along the horizontal direction, and
a second surface of the first outer case support surface formed to extend from one end of the first surface of the first outer case support surface along the vertical direction.

12. The refrigerator according to claim 11, wherein a lower end of the second surface of the first exposed surface is located at a height corresponding to that of a lower end of the second surface of the first outer case support surface.

13. The refrigerator according to claim 1, wherein
the first front flange extends along a transverse direction of the refrigerator,
the second front flange extends along a longitudinal direction of the refrigerator, and
the first front flange is coupled to the second front flange along the transverse direction.

14. The refrigerator according to claim 1, wherein the first plate comprises a first edge,
the second plate comprises a second edge facing the first edge, and
the first front flange is couplable to the second front flange by coupling the first edge to the second edge.

15. A refrigerator comprising:
an inner case forming a storage compartment and comprising a plurality of plates respectively formed by injection molding;
an outer case coupled with the inner case; and
an insulation material interposed between the inner case and the outer case,
wherein
a first plate among the plurality of plates includes a first front flange forming a part of a front surface of the inner case,
a second plate among the plurality of plates includes a second front flange forming another part of the front surface of the inner case,
the first front flange is formed to partially overlap with the second front flange along a forward and backward direction of the inner case while the first plate is coupled to the second plate,
the second front flange includes a movement prevention protrusion insertable into the first front flange to support the first front flange along a forward and backward direction, and
the movement prevention protrusion includes an upper movement prevention protrusion and a lower movement prevention protrusion, the lower movement prevention protrusion extending into the first front flange a greater distance than the upper movement prevention protrusion.

16. The refrigerator according to claim 15, wherein the first front flange comprises a hook coupler, and
the second front flange comprises a hook holder couplable to the hook coupler.

17. The refrigerator according to claim 16, wherein the hook coupler partially overlaps with the hook holder along the forward and backward direction while the first plate is coupled to the second plate.

18. The refrigerator according to claim 15, wherein the first front flange comprises a region overlapping with the movement prevention protrusion along the forward and backward direction while the first plate is coupled to the second plate.

* * * * *